US006436323B1

(12) United States Patent
North et al.

(10) Patent No.: US 6,436,323 B1
(45) Date of Patent: Aug. 20, 2002

(54) PRODUCTION OF FIBRE

(75) Inventors: Anthony Grahame North, North Thoresby; William Brunskill, Hinckley; Paul Jonathan Bradley, Ulceby; Geoffrey Pitchford, Nuneaton, all of (GB)

(73) Assignee: Technical Absorbents Limited (GB)

( * ) Notice: Subject to any disclaimer, the term of this patent is extended or adjusted under 35 U.S.C. 154(b) by 0 days.

(21) Appl. No.: 09/462,697

(22) PCT Filed: Jul. 13, 1998

(86) PCT No.: PCT/GB98/02046

§ 371 (c)(1),
(2), (4) Date: Feb. 9, 2000

(87) PCT Pub. No.: WO99/04069

PCT Pub. Date: Jan. 28, 1999

(30) Foreign Application Priority Data

Jul. 14, 1997 (GB) ..... 9714726

(51) Int. Cl.[7] ..... D01D 5/04; D01D 5/26; D01D 11/02

(52) U.S. Cl. ..... 264/103; 264/143; 264/178 F; 264/204; 264/205

(58) Field of Search ..... 264/103, 143, 264/178 F, 204, 205

(56) References Cited

U.S. PATENT DOCUMENTS 5,582,786 A 12/1996 Brunskill et al. ..... 264/103

FOREIGN PATENT DOCUMENTS

| | | |
|---|---|---|
| GB | 0692369 A | 11/1950 |
| GB | 2101642 A | 7/1981 |
| GB | 2163462 A | 2/1986 |
| WO | WO94/04724 | 3/1994 |

OTHER PUBLICATIONS

Patent Abstracts of Japan, Publication No. 58208422, Application No. 57091530, Applicant: Nippon Ester Co Ltd;, Inventor Ikeda Junji, Title: Production of Opened Synthetic Staple Fiber (Published May 12, 1983).

*Primary Examiner*—Leo B. Tentoni
(74) *Attorney, Agent, or Firm*—Howson & Howson

(57) ABSTRACT

Staple fiber is produced by extruding a solution of a polymer through a spinneret to form continuous filaments, gathering the continuous filaments to form a tow and continuously cutting the filaments in a cutter to form staple fiber. At least one jet of gas is blown at the tow before it enters the cutter to reduce smearing of polymer on the cutter. The process is particularly advantageous for treating water-soluble or water-absorbent filaments.

18 Claims, 1 Drawing Sheet

PRODUCTION OF FIBRE

FIELD OF THE INVENTION

This invention relates to improvements in the production of man-made staple fibre. Staple fibre can be produced by extruding a solution of a polymer through a spinneret to form a tow of continuous filaments and continuously cutting the filaments.

BACKGROUND ART

U.S. Pat. No. 5,582,786, for example, describes the production of a water-absorbent water-insoluble fibre by extruding an aqueous solution of a water-soluble polymer into a gaseous medium through a spinneret to form a tow of continuous extruded filaments which is collected at a moisture content of 8 to 25% based on the dry weight of the fibre. The fibre is further dried at a temperature no greater than 100° C. before crosslinking the fibre at a temperature in the range 125 to 250° C. to a degree sufficient that the crosslinked fibre is water-insoluble. The continuous filaments are cut into staple fibre while the moisture content is 8 to 25%, because completely dry fibre is brittle and tends to form fly. Cutting of the water-soluble continuous filaments at a moisture content of 8 to 25%, however, causes smearing of polymer on the cutter so that the cutter frequently needs to be cleaned, interrupting production.

DISCLOSURE OF THE INVENTION

A method according to the present invention of producing staple fibre by extruding a solution of a polymer through a spinneret to form continuous filaments, gathering the continuous filaments to form a tow and continuously cutting the filaments in a cutter to form staple fibre is characterised in that at least one jet of a gas is blown at the tow of continuous filaments before it enters the cutter.

While the method of the invention is particularly suitable for producing water-absorbent staple fibre of the type described in U.S. Pat. No. 5,582,786, it can be used for cutting any tow of man-made continuous filaments into staple fibre. The polymer solution which is extruded can for example be a solution of a synthetic polymer or a natural polymer. It can be dry spun, i.e. extruded into a gaseous medium, or wet spun, i.e. extruded into a regenerating bath. The method of the invention has particular advantages when applied to filaments spun (extruded) from acueous solution and/or still wet with aqueous solution, but it can also be applied to filaments spun from organic solvent solution. The tow of continuous filaments can be treated in tow form before cutting; for example a tow of continuous cellulose filaments can be carboxymethylated as described in WO-A-93/12275. The process of the invention is particularly suitable for cutting the resulting water-absorbent filaments into staple fibre.

The method of the invention is generally advantageous for cutting water-soluble or water-absorbent filaments. The process of the invention is also particularly suitable for cutting any tow of filaments which is cut in an uncured form, that is where the staple fibre is subsequently cured to harden the fibre, for example heated to crosslink the polymer of which the fibre is made, eg to form water-insoluble but water-absorbent fibre from a polymer which is water-soluble when extruded to form continuous filaments and cut. The method of the invention can alternatively be applied to fibres which have been crosslinked or to thermoplastic fibres which do not need crosslinking, particularly water-absorbent fibres of these types. The size of the tow may for example be from 1000 to 20000 tex. The individual filaments of the tow can for example be from 1.5 to 50 decitex; the filaments of higher decitex within this range generally cause more problems at the cutter, particularly in the case of filaments in uncured form. The method of the invention can be used when cutting any staple length, for example 2 to 80 mm, although problems at the cutter are most frequent when cutting short staple lengths such as 2 to 25 mm, especially 2 to 6 mm.

The gas blown at the tow is preferably air, although an alternative gas, for example nitrogen, can be used. The temperature of the gas blown at the tow is preferably below 50° C., for example −5 to +20° C. The velocity of the gas blown at the tow should generally be sufficient to open the tow, that is to say to separate the filaments of the tow. The gas can for example be at a pressure of 20 to 100 or 150 psi (140 to 700 or 1050 kPa), preferably 30 to 80 psi (200 to 550 kPa)

The gas is preferably blown at the tow in a direction substantially normal to the direction of travel of the tow, generally at an angle to the direction of travel of the tow within the range 75–105°, so that the gas has no substantial forwarding or retarding effect on the tow.

The air or other gas is preferably blown at the tow of continuous filaments so that it impinges on the tow from opposite sides of the tow. The tow is preferably spread widthways, for example by a spreader bar or roller, before the air or other gas is blown at the tow, or tow from several spinning ends can be fed side by side to form a wide flat tow. The air or other gas is preferably blown at the tow from a series or row of holes or slots which are spaced apart in a direction normal to the direction of the travel of the tow, for example about 5–15 mm apart. Most preferably, the holes, slots or series or rows of holes or slots are spaced apart in the direction of travel of the tow, so that air is blown from a 2-dimensional array of holes. The holes in successive rows may be staggered so that each filament of the tow comes close to passing over at least one hole. Most preferably the tow passes between two opposed manifolds each having such an array of holes. Each hole is for example 0.1 to 2 mm in diameter, preferably 0.5–1 mm. Alternatively, one or more slots, for example of the dimensions and type used in an air knife, can be used. Such slots are generally less than 1 mm wide The slots are preferably arranged with their lengthwise direction perpendicular to the direction of travel of the tow. In this way the slot or slots can extend across the whole width of the tow. Passing air under pressure through such holes or slots causes adiabatic cooling so that the air impinging on the tow is cooler than the air entering the manifold or air knife. One or more manifold of holes and one or more air knife slots can be used in sequence, in either order, to treat the tow.

The tow is preferably under low tension as it passes the jets of air or other gas, that is to say the rollers feeding the tow to the blower and the rollers receiving the tow from the blower operate at substantially the same speed. A high tension will tend to prevent the air jets opening the tow, while any significant overfeed could lead to looping or interlacing of the tow.

The gas blowing process can be carried out at any position between the tow forming and tow cutting operations. It is most preferably carried out just before the cutter so that the tow entering the cutter retains the reduced moisture content and reduced temperature imparted by the gas blast.

The cutter is preferably a rotary cutter, suitably with blades rotating about an axis in approximately the direction of travel of the tow within a housing which constrains the tow. One example is a Neumag NMC 450. An alternative is a Fleischner F 514.

The problems overcome by the method of the invention include filaments clumping together to form chunks of polymer between the cutter blades and smearing of polymer from the fibres on the cutter blade surface, causing inefficiency in cutting and eventual jamming of the cutter. We believe that one effect of the blast of gas is to remove surface moisture (both external and interstitial) from the filaments. The gas also has a cooling effect; for example a tow may be cooled from 60° C. to 50° C. by gas blown at 10° C. even when the tow is travelling at 200–800 m/minute.

BRIEF DESCRIPTION OF DRAWINGS

The invention will now be described by way of example with reference to the accompanying drawings, of which.

Figure 1:
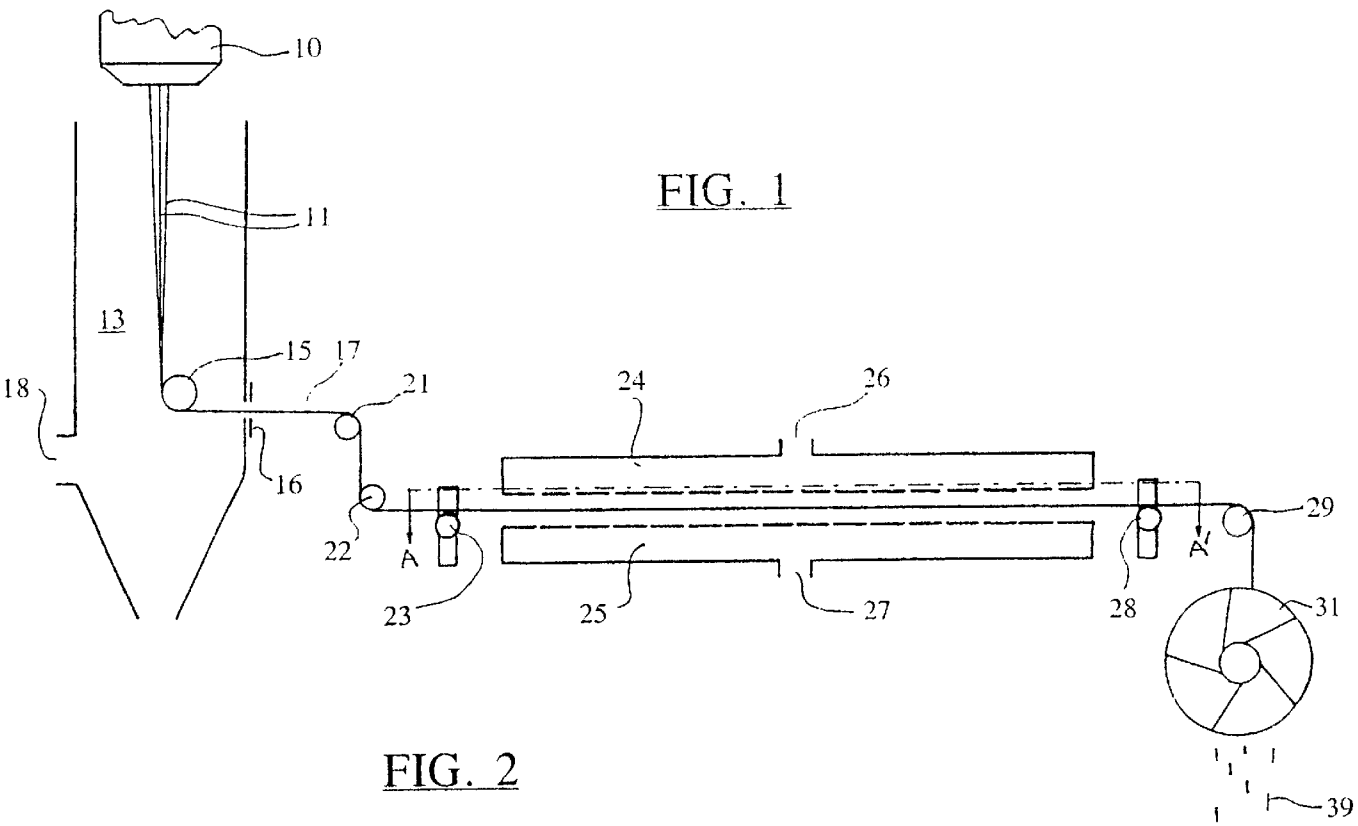
FIG. 1 is a diagrammatic cross-section of apparatus for carrying out the invention.

Referring to the drawings, a heated and filtered spinning dope is extruded through a spinneret 10 to form filaments 11 in a dry spinning cell 13. The extruded filaments 11 are dried and solidified as they pass down the cell 13 and are collected around a godet 15. The filaments emerge from the side of the drying chamber of the cell 13, through a small hole 16, in the form of a tow 17. Most of the hot air in cell 13 exits through outlet 18. A stream of cold air is fed into the cell through base 19 to stop the hot air coming out that way. The cooling of the hot moisture-laden air may cause condensation on the tow 17, which is a cause of fibres clumping together in the cutter.

The tow 17 passes around godets 21 and 22 to a roller or spreader bar 23 where it is spread widthways. Tows from several spinning cells may be combined and fed to one spreader bar 23. The tow then passes between manifolds 24, 25 having air inlets 26, 27 to a second roller or spreader bar 28 and via a godet 29 to cutter 31. The manifolds 24 and 25 each have an array of holes 32 spaced apart lengthwise and widthwise. The spreader bars 23 and 28 have stops 34, 35 and 36, 37 respectively to control the widthwise spread of the tow to the width of the array of holes in the manifolds 24 and 25. The tow is cut by cutter 31 into staple fibre 39 which may be further dried, for example as described in U.S. Pat. No. 5,582,786.

In a typical example a tow of about 4000–5000 uncured water-absorbent filaments of the type described in U.S. Pat. No. 5,582,786, each of 10 decitex having a moisture content of 15% by weight and a temperature of 55–60° C., was passed between two air manifolds 24, 25, 2 to 3 cm apart, each about 1 metre long and having an array of holes over a width of 8 cm. Compressed air at ambient temperature was fed to the manifolds 24, 25; the air blown at the tow from holes 32 was cooler (estimated at about 10° C.). The air pressure was varied between 35 and 80 psi (240 kPa and 550 kPa) and the cutter operated effectively at each pressure with no smearing over several days' operation when cutting 6 mm staple fibre, compared to smearing within hours if no air was blown at the tow. The temperature of the tow was reduced by about 10° C. The moisture content of the tow was reduced by less than 1% by weight.

Figure 2:
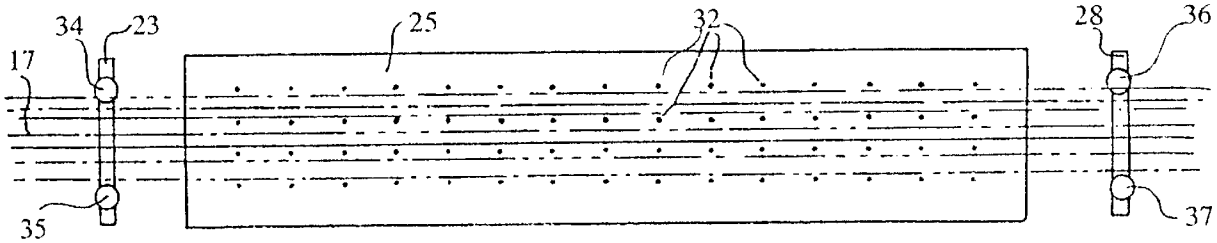
FIG. 2 is a plan view of part of the apparatus of FIG. 1 on the line A . . . A'.

In a further example the apparatus of FIGS. 1 and 2 was used with the addition of four air knives in each of which air was blown from a 8 cm long 0.5 mm wide slot at 60 psi (410 kPa). The four slots were arranged in series in the direction of travel of the tow between the manifolds 24, 25 and the roller 28, although some or all of them could equally well be positioned between the spreader bar 23 and the manifolds 24, 25. The air emerging from each air knife is adiabatically cooled to 0–5° C. This modified apparatus was used successfully to cut a tow of 4000 uncured 20 decitex water-absorbent filaments of the type described in U.S. Pat. No. 5582786 into 6 mm staple fibre and into 3 mm staple fibre.

The series of four air knives could alternatively be used instead of the manifolds 24, 25.

What is claimed is:

1. A method of producing staple fibre by extruding a solution of a polymer in a solvent through a spinneret to form continuous filaments bearing solvent on their surfaces, gathering the continuous filaments to form a tow and continuously cutting the filaments in a cutter to form staple fibre, in which method at least one jet of a gas is blown at the tow of continuous filaments to remove solvent from the surfaces of the filaments before the tow enters the cutter, the at least one jet being blown at the tow in a direction substantially normal to the direction of travel of the tow so that gas has no substantial forwarding or retarding effect on the tow.

2. A method according to claim 1, wherein the continuous filaments are produced by extrusion of an aqueous solution.

3. A method according to claim 1, wherein the continuous filaments are produced by extrusion of the solution into a gaseous medium.

4. A method according to claim 1, wherein, after cutting, the staple fibre is cured to harden the fibre.

5. A method according to claim 4, wherein the step of curing the fibre comprises heating the fibre to crosslink the polymer.

6. A method according to claim 1, wherein the filaments being cut are water-soluble or water-absorbent.

7. A method according to claim 6, wherein the polymer is a polymer which is water-soluble when it is extruded into filaments and cut and which is subsequently crosslinked by heating to form water-absorbent water-insoluble fibre.

8. A method according to claim 1, wherein the pressure of the gas blown at the tow is 30 to 100 psi (200 to 700 kPa).

9. A method according to claim 1, wherein the gas impinges on the tow from opposite sides of the tow.

10. A method according to claim 1, wherein the gas is blown at the tow from one or more slots arranged with their lengthwise direction perpendicular to the direction of travel of the tow.

11. A method according to claim 1, wherein the gas is blown at the tow from a series of holes or slots spaced apart in a direction normal to the direction of travel of the tow.

12. A method according to claim 9, wherein he tow is spread widthwise before the gas is blown at the tow.

13. A method according to 1, wherein the gas is blown at the tow from a series of holes or slots spaced apart in the direction of travel of the tow.

14. A method according to claim 1, wherein the cutter is a rotary cutter.

15. A method according to claim 1, wherein the at least one jet of gas also has a cooling effect on the tow.

16. A method according to claim 2, wherein the temperature of the at least one jet of gas is from −5° C. to +20° C.

17. A method according to claim 1, wherein the at least one jet of gas is blown at the tow at an angle within the range 75° to 105° to the direction of travel of the tow.

18. A method according to claim 1, wherein the at least one jet of gas is blown at the tow at a velocity sufficient to separate the filaments of the tow.

* * * * *